United States Patent [19]

Yamazaki et al.

[11] 4,117,672

[45] Oct. 3, 1978

[54] EXHAUST REACTION CHAMBER SYSTEM OF ENGINE

[75] Inventors: Shuichi Yamazaki, Kamifukuoka; Ikuo Kajitani, Niiza; Yasuo Kosato, Ooimachi, all of Japan

[73] Assignee: Honda Giken Kogyo Kabushiki Kaisha, Tokyo, Japan

[21] Appl. No.: 712,348

[22] Filed: Aug. 6, 1976

[30] Foreign Application Priority Data

Aug. 15, 1975 [JP] Japan ..... 50/112068[U]
Aug. 15, 1975 [JP] Japan ..... 50/112069[U]

[51] Int. Cl.[2] ..... F01N 3/10
[52] U.S. Cl. ..... 60/282; 60/323
[58] Field of Search ..... 60/282, 322, 323

[56] References Cited

U.S. PATENT DOCUMENTS

| | | | |
|---|---|---|---|
| 3,633,368 | 1/1972 | Rosenlund | 60/323 |
| 3,722,221 | 3/1973 | Chopin | 60/282 |
| 3,839,862 | 10/1974 | Gota | 60/282 |
| 3,990,234 | 11/1976 | Kajitani | 60/323 |
| 3,994,271 | 11/1976 | Ishizuya | 60/282 |
| 4,016,846 | 4/1977 | Nakano | 123/52 M |

*Primary Examiner*—Douglas Hart
*Attorney, Agent, or Firm*—Lyon & Lyon

[57] ABSTRACT

An engine exhaust reaction chamber system having an inner exhaust reaction chamber surrounded by an outer exhaust reaction chamber, the system having a partition plate means for preventing exhaust flow bypass through the outer exhaust reaction chamber positioned within the annular space of the outer exhaust reaction chamber. A guide plate may also be positioned within the annular space of the outer exhaust reaction chamber in order to separate the outer exhaust reaction chamber into first and second outer exhaust reaction chamber passages. Further, a middle exhaust reaction chamber may be positioned between the inner and outer exhaust reaction chambers, the middle exhaust reaction chamber also being provided with a partition plate in order to prevent exhaust flow bypass through the middle exhaust reaction chamber and being provided with a guide plate separating the middle exhaust reaction chamber into first and second middle exhaust reaction chamber passages.

9 Claims, 2 Drawing Figures

EXHAUST REACTION CHAMBER SYSTEM OF ENGINE

This invention relates to an exhaust reaction chamber system for engines.

It is known to provide an exhaust chamber in the exhaust manifold of an internal combustion engine in order to effect purification of exhaust gases through the use of oxidation and other catalysts. A problem associated with such reaction chambers is that of exhaust gas bypass wherein the exhaust gases bypass the bulk, or at least a portion, of the reaction chamber and are not fully purified. A further problem associated with such exhaust gas bypass is an increase in the engine back pressure so as to produce a turbulence which alters the engine operation.

It is a purpose of this invention to provide an improved exhaust reaction chamber system. Other objectives will be apparent upon a reading of the entire specification, drawings and claims.

The present invention provides for an exhaust reaction chamber system wherein an inner exhaust reaction chamber is annularly surrounded by an outer exhaust reaction chamber. Partition plate means may be positioned wthin the outer exhaust reaction chamber in order to prevent exhaust flow bypass through the outer exhaust reaction chamber. Further, the guide plate may be positioned within the outer exhaust reaction chamber in order to further prevent bypass by separating the outer exhaust reaction chamber into first and second outer exhaust reaction chamber passages, the first outer exhaust reaction chamber passage connecting the outer exhaust reaction chamber inlet to the second outer exhaust reaction chamber passage, and the second outer exhaust reaction chamber passage connecting the first outer exhaust reaction chamber to the outer exhaust reaction chamber outlet.

Further, a middle exhaust reaction chamber may be positioned between the inner and outer exhaust reaction chambers, the middle exhaust reaction chamber also being provided with a partition plate for preventing exhaust flow bypass through the middle exhaust reaction chamber and a middle exhaust reaction chamber guide plate separating the middle exhaust reaction chamber into first and second middle exhaust reaction chamber passages. In preferred embodiments, the outer exhaust reaction chamber is surrounded by insulated material. In a further preferred embodiment, the inner exhaust reaction chamber exterior forms the interior of the outer exhaust reaction chamber. In the embodiment which utilizes inner, middle and outer exhaust reaction chambers, the exterior of the inner exhaust reaction chamber forms the interior of the middle exhaust reaction chamber, and the exterior of the middle exhaust reaction chamber forms the interior of the outer exhaust reaction chamber.

Figure 1:
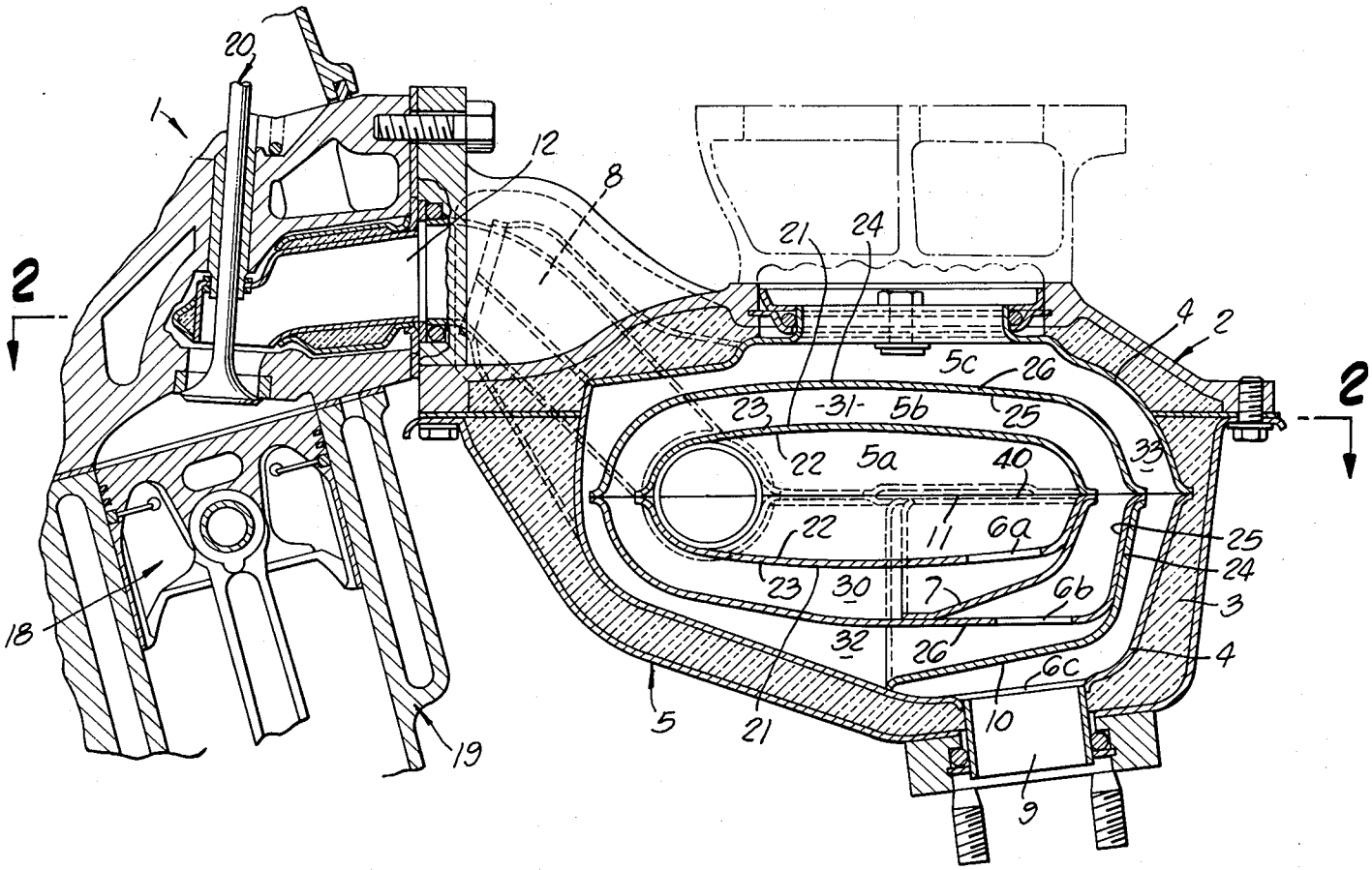
FIG. 1 is a cross-sectional view of an engine exhaust reaction chamber system of the present invention.

Referring now to FIG. 1, a portion of an engine 1 is shown having at least one cylinder 19 housing a piston 18 and including an exhaust valve 20 connected with an exhaust port 12. An inner exhaust reaction chamber 5*a* is shown to be in communication with the exhaust port 12 through inlets 8 of exhaust manifold 5. The inner exhaust reaction chamber 5*a* is formed by a wall member 21 having an interior surface 22 and an exterior surface 23. A middle exhaust reaction chamber 5*b* may be positioned annularly about the inner exhaust reaction chamber 5*a*. The middle exhaust reaction chamber is formed by means of wall members 21 and 24, wall member 24 having an interior surface 25 and an exterior surface 26. The inner exhaust reaction chamber 5*a* is connected to the middle exhaust reaction chamber 5*b* by means of a connection 6*a* which functions as the outlet of the inner exhaust reaction chamber 5*a* and the inlet to the middle exhaust reaction chamber 5*b*.

An outer exhaust reaction chamber 5*c* may be positioned annularly about the middle exhaust reaction chamber 5*b* and formed by wall member 4 and wall member 24. The outer exhaust reaction chamber 5*c* is connected to the middle exahust reaction chamber 5*b* by means of a connection 6*b* which acts as the outlet for the middle exhaust reaction chamber 5*b* and the inlet to the outer exhaust reaction chamber 5*c*. The outer exhaust reaction chamber 5*c* has a connection 6*c* forming an inlet of an exhaust manifold outlet 9. Partition plates 7 and 10 may be positioned between wall members 21 and 24 and 24 and 4 respectively in order to prevent exhaust gas bypass directly through the middle and outer exhaust reaction chambers 5*b* and 5*c* from the connection 6*a* to the connection 6*b* and from the connection 6*b* to the connection 6*c*.

Figure 2:
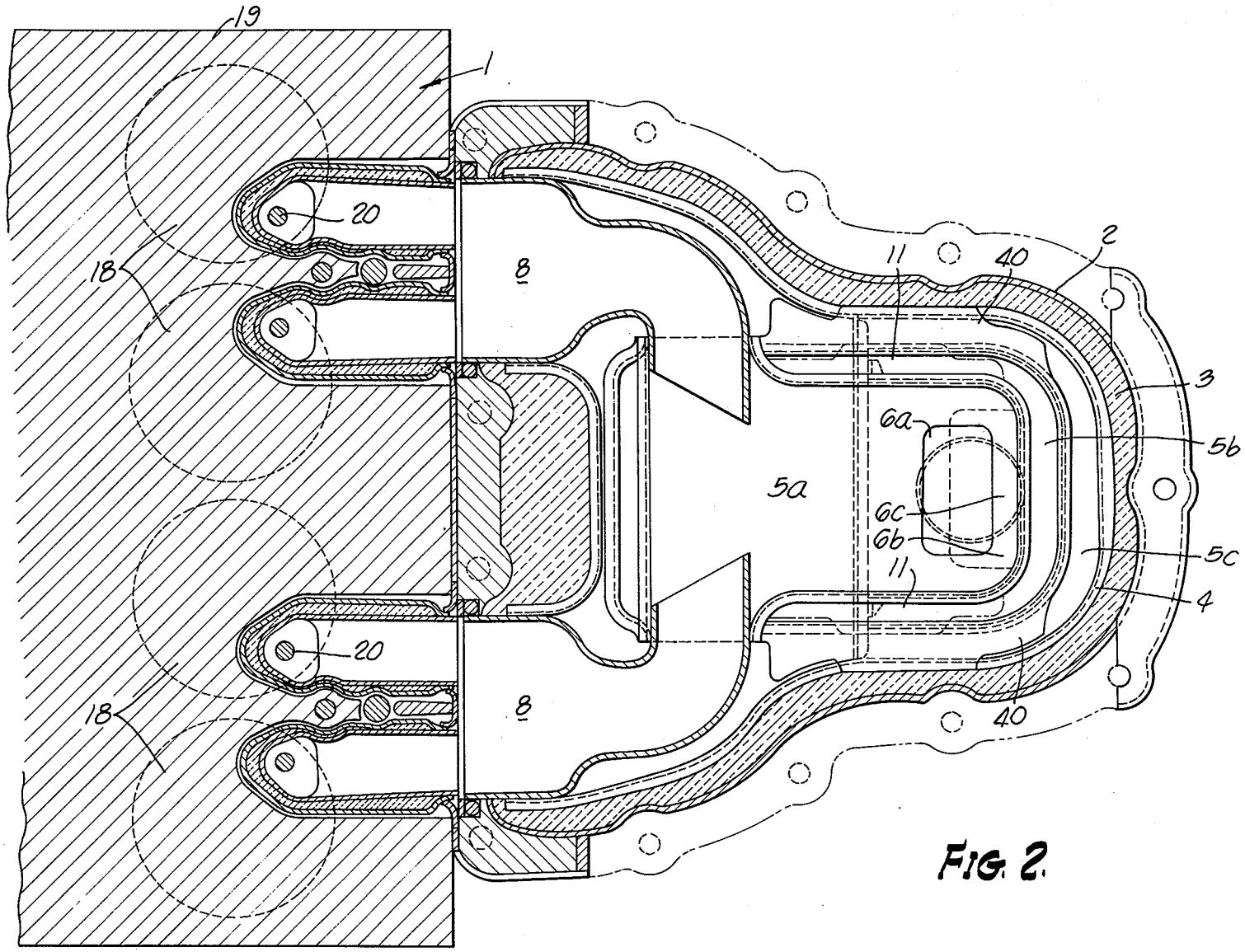
FIG. 2 is a cross-sectional view taken about 2—2 of FIG. 1.

In a preferred embodiment, as is more clearly illustrated when viewed in FIG. 2, a first guide plate 11 may be positioned within the annular space of the middle exhaust reaction chamber 5*b* in order to divide the middle exhaust reaction chamber into first and second middle exhaust reaction chamber passages of approximately equal arcuate length in order to further preclude exhaust gases from short circuiting the annular passageway of the middle exhaust reaction chamber 5*b*. The first guide plate 11 requires that the exhaust gases pass through a first middle exhaust reaction chamber passage 30 and a second middle exhaust reaction chamber passage 31 prior to exiting the middle exhaust reaction chamber 5*b* at connection 6*b*. Similarly, a second guide plate 40 may be positioned wihtin the annular space of the outer exhaust reaction chamber 5*c* in order to separate the outer exhaust reaction chamber 5*c* into first and second outer exhaust reaction chamber passages 32 and 33 in order to prevent the short circuiting of exhaust gases through the outer exhaust reaction chamber 5*c* and to require that the exhaust gases pass through the outer exhaust reaction chamber 5*c* by passing through the connection 6*b* into a first outer exhaust reaction chamber passage 32 and then into a second outer exhaust reaction chamber passage 33 prior to exiting the engine exhaust reaction chamber system at 6*c* and 9.

In a preferred embodiment, a layer of insulative material 3 is utilized in order to render the reaction occurring within the exhaust reaction chamber substantially heat insulated. An outer assembly for the exhaust manifold is referred to in FIGS. 1 and 2 as 2.

Having described the invention, it will be apparent to those skilled in the art that additional forms thereof may be employed and it is accordingly intended to be limited only by the scope of the appended claims.

What is claimed is:

1. In an engine exhaust reaction chamber system including an exhaust manifold having an inlet and an outlet, the improvement comprising: an inner exhaust reaction chamber having an outlet and inlet, said inlet being in communication with said exhaust manifold inlet; an outer exhaust reaction chamber annularly enveloping said inner exhaust reaction chamber and having an inlet in communication with said inner exhaust reaction chamber outlet and an outlet in communication with said exhaust manifold outlet; a guide plate positioned within said outer exhaust reaction chamber, said guide plate separating said outer exhaust reaction chamber into first and second outer exhaust reaction chamber passages, said first outer exhaust reaction chamber passage connecting said outer exhaust reaction chamber inlet to said second outer exhaust reaction chamber passage and said second outer exhaust reaction chamber passage connecting said first outer exhaust reaction chamber passage to said outer exhaust reaction chamber outlet; and a partition plate means positioned within said outer exhaust reaction chamber for preventing flow bypass between said inner exhaust reaction chamber outlet and said outer exhaust reaction chamber outlet, whereby exhaust manifold gases are forced to pass in the same direction through the annular space within said outer exhaust reaction chamber prior to exiting said exhaust manifold.

2. The engine exhaust reaction chamber system claimed in claim 1 wherein said outer exhaust reaction chamber is surrounded by an insulative material.

3. The engine exhaust reaction chamber system claimed in claim 1 wherein the exterior of said inner exhaust reaction chamber forms the interior of said outer exhaust reaction chamber.

4. In an engine exhaust reaction chamber system including an exhaust manifold havng an inlet and an outlet, the improvement comprising: an inner exhaust reaction chamber having an outlet, and an inlet in communication with said exhaust manifold inlet; a middle exhaust reaction chamber positioned annularly about said inner exhaust reaction chamber and having an outlet, and an inlet in communication with said inner exhaust reaction chamber outlet; an outer exhaust reaction chamber positioned annularly about said middle exhaust reaction chamber and having an outlet in communication with said exhaust manifold outlet and an inlet in communication with said middle exhaust reaction chamber outlet; a first partition plate means, positioned within said middle exhaust reaction chamber, for preventing exhaust gas bypass flow between said inner exhaust reaction chamber outlet and middle exhaust reaction chamber outlet; and a second partition plate means, positioned within said outer exhaust reaction chamber, for preventing exhaust gas bypass flow between said middle exhaust reaction chamber outlet and said outer exhaust reaction chamber outlet, whereby exhaust manifold gases are forced to pass sequentially through said inner, middle and outer exhaust reaction chambers prior to exiting said exhaust manifold.

5. The engine exhaust reaction chamber system claimed in claim 4 wherein said system is further defined as including a first guide plate positioned within said middle exhaust reaction chamber, said first guide plate separating said middle exhaust reaction chamber into first and second middle exhaust chamber passages, said first middle exhaust reaction chamber passage connecting said middle exhaust reaction chamber inlet to said second middle exhaust reaction chamber passage, and said second middle exhaust reaction chamber passge connecting said first middle exhaust reaction chamber passage to said middle exhaust reaction chamber outlet; and a second guide plate positioned within said outer exhaust reaction chamber, said second guide plate separating said outer exhaust reaction chamber into first and second outer exhaust reaction chamber passages, said first outer exhaust reaction chamber passage connecting said outer exhaust reaction chamber inlet to said second outer exhaust reaction chamber passage, and said second outer exhaust reaction chamber passage connecting said first outer exhaust reaction chamber passage to said outer exhaust reaction chamber outlet.

6. The engine exhaust reaction chamber system claimed in claim 4 wherein said outer exhaust reaction chamber is surrounded by an insulative material.

7. The engine exhaust reaction chamber system claimed in claim 5 wherein said outer exhaust reaction chamber is surrounded by an insulative material.

8. The engine exhaust reaction chamber system claimed in claim 4 wherein the exterior of said inner exhaust reaction chamber forms the interior of said middle exhaust reaction chamber, and the exterior of said middle exhaust reaction chamber forms the interior of said outer exhaust reaction chamber.

9. A method of preventing increase of engine back pressure in an exhaust reaction chamber system comprising: passing exhaust gases into an inner exhaust reaction chamber; passing said exhaust gases into a middle exhaust reaction chamber which surrounds said inner exhaust reaction chamber and includes first and second middle exhaust reaction chamber passages; circulating said exhaust gases through the arcuate length of said first and second middle exhaust reaction chamber passages; preventing exhaust gas bypass through said middle exhaust reaction chambers; passing said exhaust gases into an outer exhaust reaction chamber which surrounds said middle exhaust reaction chamber and includes first and second outer exhaust reaction chamber passages; circulating said exhaust gases through the arcuate length of said first and second outer exhaust reaction chamber passages; preventing exhaust gas bypass through said outer exhaust reaction chamber; and exhausting said exhaust gases from said exhaust reaction chamber system.

* * * * *